United States Patent [19]

Fukuroi

[11] Patent Number: 4,989,300

[45] Date of Patent: Feb. 5, 1991

[54] COUPLING ELEMENT FOR SLIDE FASTENER

[75] Inventor: Takeo Fukuroi, Uozu, Japan

[73] Assignee: Yoshida Kogyo, K.K., Tokyo, Japan

[21] Appl. No.: 456,377

[22] Filed: Dec. 26, 1989

[30] Foreign Application Priority Data

Dec. 28, 1988 [JP] Japan ..... 63-331938

[51] Int. Cl.[5] ..... A44B 19/40

[52] U.S. Cl. ..... 24/391; 24/392

[58] Field of Search ..... 24/391, 392, 381, 575

[56] References Cited

U.S. PATENT DOCUMENTS

| | | | |
|---|---|---|---|
| 1,407,370 | 2/1922 | Blee et al. | 24/391 |
| 2,919,482 | 1/1960 | Casson | 24/391 |
| 3,015,868 | 1/1962 | Ruhrmann et al. | 24/391 |
| 3,247,871 | 4/1966 | Lacam et al. | 24/392 |
| 3,336,640 | 8/1967 | Chery | 24/391 |
| 3,613,180 | 10/1971 | Burbank | 24/391 |
| 3,947,931 | 4/1976 | Takamatsu | 24/391 |

*Primary Examiner*—Victor N. Sakran

*Attorney, Agent, or Firm*—Hill, Van Santen, Steadman & Simpson

[57] ABSTRACT

A coupling element for slide fastener is formed from a monofilamentary material such as polyester, nylon and like thermoplastic resins into a continuous meandering or zig-zag structure having a substantially semi-circular transverse cross-section, the coupling element having a coupling head, an upper leg and a lower leg extending oppositely from said head in parallel spaced apart relation and a heel interconnecting each of the upper and lower legs. The heel is oriented by rotation through 90° or 180° and protrudes at least in part beyond the outer surface of the leg thereby providing increased surface area of the heel for sliding contact with a slider.

8 Claims, 6 Drawing Sheets

COUPLING ELEMENT FOR SLIDE FASTENER

BACKGROUND OF THE INVENTION

1. Field of the Invention

This invention relates generally to slide fasteners and particularly to coupling elements therefor. More particularly, the invention is directed to such coupling elements which have a cross-sectionally semi-circular configuration and which are formed into a continuous meandering structure.

2. Prior Art

Slide fasteners having coupling elements of the character described find wide application as closure devices for garment articles, bags, suitcases, coverings and the like. Coupling elements having a semi-circular transverse cross-section formed from a synthetic resinous monofilament into a meandering or zig-zag structure are already known as disclosed for example in Japanese Pat. Publication No. 39-9390 (corresponding to U.S. Pat. No. 2,919,482).

Due to its physical peculiarity of being sectionally semi-circular and hence relatively small in radius, the monofilament is difficult to be freely bent or otherwise formed into a meandering structure with its flat surface aligned in a common plane and without causing the monofilament to become wavy or run off a predetermined track on opposite surfaces of a stringer tape. This makes it difficult to pass the sewing threads properly on the monofilament and through the tape. Furthermore, the monofilament being sectionally semi-circular provides limited contact areas to be guidedly threaded through a slider and hence opposed rows of coupling elements made from such monofilament would fail to be brought securely together, or would undergo what is known as "chain crack". Improper or loose coupling condition of the coupling elements would also lead to their deformation or damage when jammed between the stringer tape and the slider flanges.

SUMMARY OF THE INVENTION

It is therefore the primary object of the present invention to provide a continuous row of meandering coupling elements having a semi-circular transverse cross-section for slide fasteners which will preclude the foregoing difficulties of the prior art.

A more specific object of the invention is to provide a continuous row of coupling elements having a semi-circular transverse cross-section for slide fasteners which ensures strong and stable interengagement with a companion element row by smooth sliding contact with a slider.

Another specific object of the invention is to provide coupling elements of the character mentioned which can be easily removed for gapping or providing element-free sections on a slide fastener stringer.

These and other objects and features of the invention will appear more apparent from reading the following detailed description with reference to the accompanying drawings.

According to the invention, there is provided a coupling element for a slide fastener which is formed from a substantially cross-sectionally semi-circular monofilamentary material into a continuous meandering structure mounted on a stringer tape, said element having a coupling head, an upper leg and a lower leg respectively extending from opposite ends of said head and a heel interconnecting said legs, at least a portion of said heel protruding beyond the outer surfaces of each of said legs.

DETAILED DESCRIPTION

Figure 1:
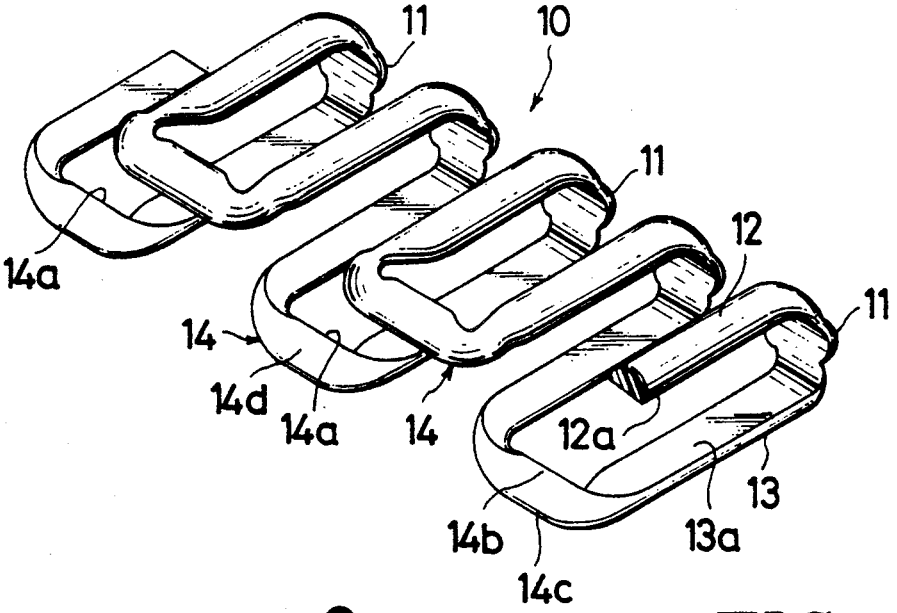
FIG. 1 is a perspective view on enlarged scale of a row of meandering coupling elements embodying the invention.
Figure 6:
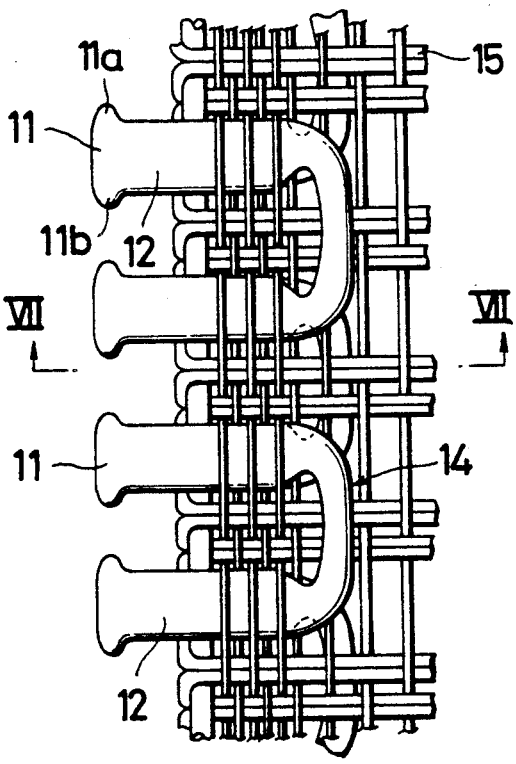
FIG. 6 is a plan view of the coupling elements shown woven into the tape.
Figure 19A:
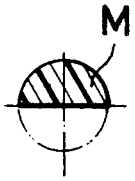
FIGS. 19*a*–19*d* inclusive are transverse cross-sectional views of starting monofilaments from which the coupling elements of the invention may be formed.
Figure 19B:
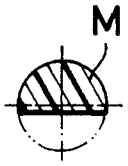
Figure 19C:
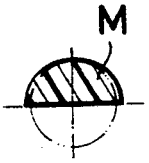
Figure 19D:
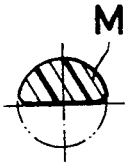

Referring now to the drawings and FIG. 1 in particular, there is shown a length of coupling elements 10 formed from a monofilament of a thermoplastic resin such as polyester, nylon and the like into a continuous meandering or zig-zag structure. The monofilament designated at M in FIGS. 19*a*–19*d* has a substantially semi-circular transverse cross-section. An example shown in FIG. 19*a* is truely semi-circular in cross-section; that in FIG. 19*b* has a semi-circular cross-section slightly higher than the example of FIG. 19*a*; that in FIG. 19*c* has a cross-sectional configuration somewhat elongated; and that in FIG. 19*d* has a semi-circular cross-section canted along both of its longitudinal edges. Each of the elements 10 as observed indivisually consists of a coupling head 11 which is flattened out to provide on opposite slides thereof a pair of engaging ribs 11*a* and 11*b* as shown in FIG. 6, an upper leg 12 and a lower leg 13 respectively extending horizontally from the upper and lower ends of the head 11 and a heel 14 extending alternately from and interconnecting respective upper legs 12 and lower legs 13 of adjacent coupling elements 10.

The upper leg 12 and the lower leg 13 of each element 10 merge through the heel 14 into the corresponding upper and lower legs 12 and 13, respectively, of the next adjoining element 10 and extend in superimposed spaced apart relation to each other with their respective flat or planar surfaces 12*a* and 13*a* oriented in confrontation. Therefore, the upper and lower legs 12 and 13 in each of the successive elements 10 run in parallel with one another and are interconnected so as to present a substantially "U"-shaped configuration when observed in plan view as better shown in FIGS. 2 and 6.

Figure 2:
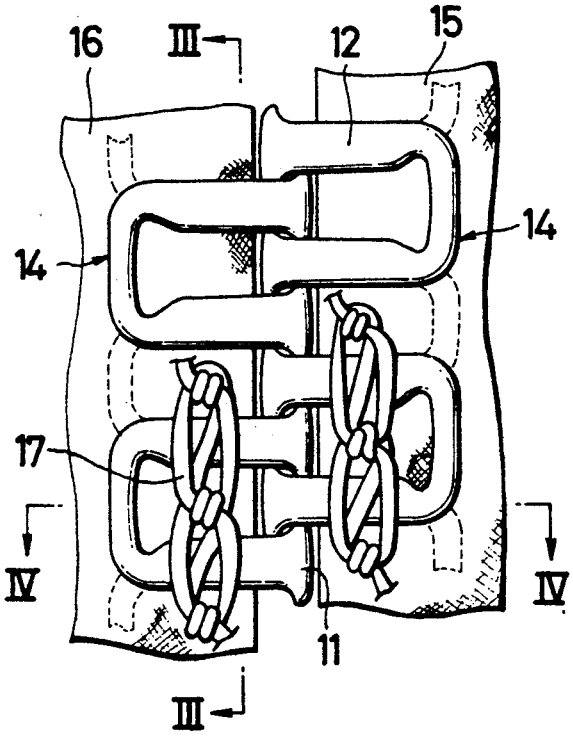
FIG. 2 is a plan view of the same in two rows shown mounted on stringer tapes.
Figure 3:
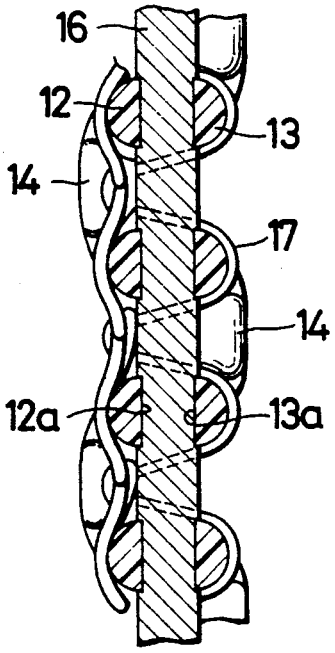
FIG. 3 is a longitudinal cross-sectional view taken on the line III—III of FIG. 2.

As shown in FIG. 2, a row of coupling elements 10 is mounted on one of a pair of opposed stringer tapes 15 and 16 with the respective planar surfaces 12*a* and 13*a* of the upper and lower legs 12 and 13 directed in face-to-face relation to respective upper and lower surfaces of the tape 15, (16) and with the coupling head 11 protruding beyond a longitudinal edge of the tape 15, (16) so as to be engageable with the heads 11 in adjacent elements 10 on the opposite companion tape 16. The two rows of coupling elements 10 are secured to their respective stringer tapes 15 and 16 by means of sewn seams 17 as shown in FIG. 2.

According to an important aspect of the invention, the heel 14 of each unit element 10 is oriented as by stamping or clamping so that at least a portion of the heel 14 protrudes beyond the outer surfaces of the leg 12, (13). Orientation of the heel 14 may be done either before or after the monofilament M is formed into a meandering element structure.

Figure 4:
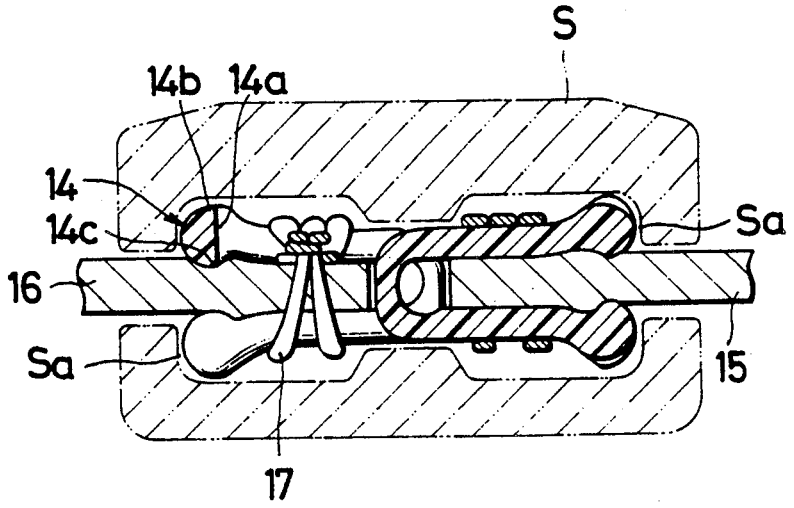
FIG. 4 is a transverse cross-sectional view of FIG. 2 showing the two rows of coupling elements coupled together by a slider.
Figure 5:
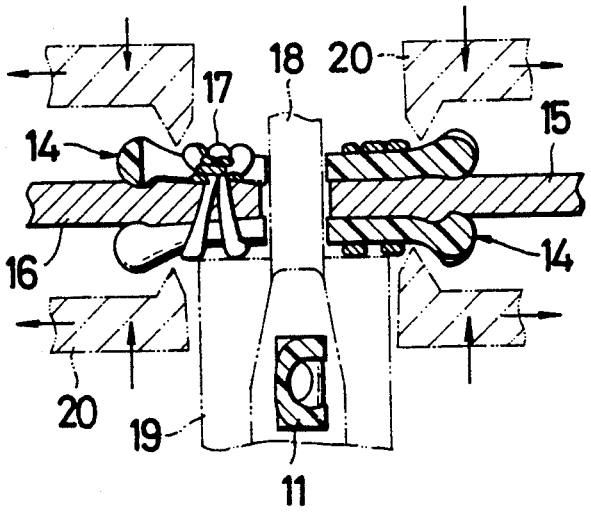
FIG. 5 is a transverse cross-sectional view of FIG. 2 showing how the coupling elements are removed from the respective tapes.

According to a preferred embodiment of the invention, the heel 14 is oriented 90 degrees so as to direct the majority of its planar surface 14*a* inwardly toward the coupling head 11 with the result that the upper edge 14*b* and lower edge 14*c* of the heel 14 are raised to protrude beyond or lie above the outer surface levels of the upper leg 12 and lower leg 13, respectively as better shown in FIG. 4. Advantagenously, a rounded or arcuate outer surface 14*d* of the oriented heel 14 provides increased guide surface for sliding engagement with an inner flange wall Sa of a slider S thereby enhancing smooth operation of the slider S. Further advantagenously, the oriented heel 14 protects the sewn seam 17 from coming into frictional contact with the interior surfaces of the slider S. Still further advantageously, a gapping operation to provide element-free portions at pretermined intervals on the stringer tapes 15, 16 is greatly facilitated as illustrated in FIG. 5, in which a predetermined length of coupling elements 10 after having their heads 11 cut off by punch 18 and die 19 can be easily removed on account of the raised edges 14*b*, 14*c* of the oriented heels 14 serving as abutments for grippers 20 to firmly grip and smoothly take away the length of elements 10 that has been cut.

Figure 8:
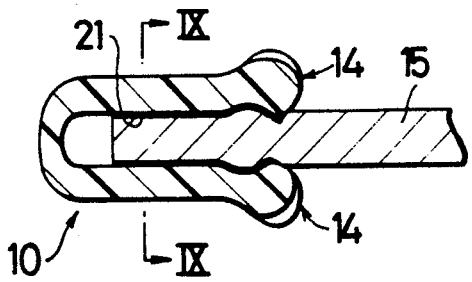
FIG. 8 is a transverse cross-sectional view of the coupling element shown secured to the tape edge.
Figure 9:
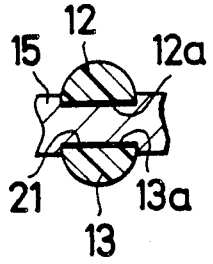
FIG. 9 is a cross-sectional view taken on the line IX—IX of FIG. 8.

In place of the sewn seams 17, there may be employed a supersonic or high-frequency bonding procedure for securing the row of coupling elements 10 to the stringer tape 15, (16) as shown in FIGS. 8 and 9, in which instance the planar surfaces 12*a* and 13*a* of the upper and lower legs 12 and 13 are registered with and fused as at 21 to the respective surfaces of the stringer tape 15, (16). The elements 10 may be alternatively adhesively secured to the stringer tape 15, (16).

Figure 7:
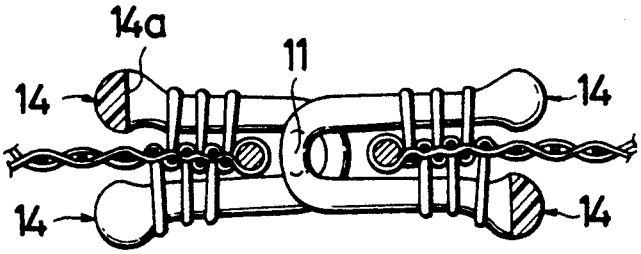
FIG. 7 is a transverse cross-sectional view taken on the line VII—VII of FIG. 6.

Further alternatively, the monofilament M which forms a row of meandering elements 10 may be woven simultaneously with weaving of a stringer tape in a manner well known in the art as shown in FIGS. 6 and 7.

While in the embodiment shown in FIGS. 1 and 4 in particular the major portion of the heel 14 of the element 10 is raised by orientation above the outer surface of the leg 12, (13), substantially equivalent results can be obtained by arranging at least a portion of the heel 14 to protrude beyond the outer surface of the leg 12, (13).

Figure 10:
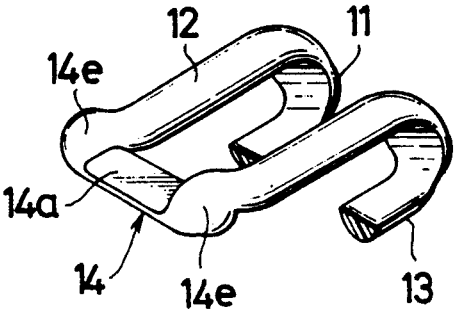
FIGS. 10 through 18, inclusive, are perspective views of modified forms of coupling elements embodying the invention.

FIG. 10 shows a unit coupling element 10 of a meandering or zig-zag form which has its heel 14 twisted by rotation counterclockwise through 180° with the planar surface 14*a* of the heel 14 lying parallel with but opposite to the tape surface. Thus twisting the element 10 causes the heel 14 to deform at opposite ends thereof and create bulged shoulders 14*e* which protrude beyond the outer surfaces of the leg 15, (16).

Figure 11:
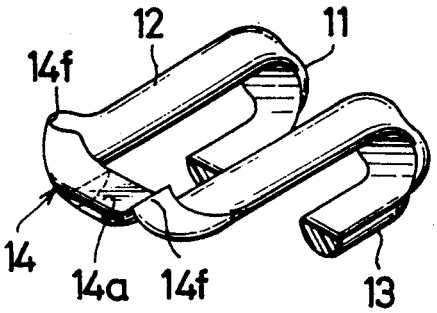

FIG. 11 shows a modification similar to the element 10 of FIG. 10 but having the heel 14 twisted clockwise through 180° with its planar surface 14*a* lying likewise opposite to the tape surface, thereby producing projections 14*f* at opposite ends of the heel 14.

Figure 12:
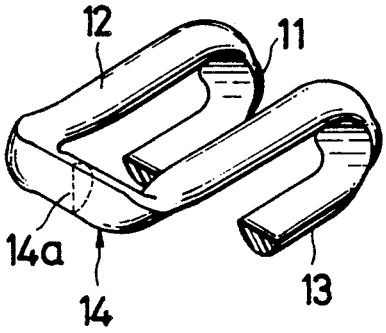

FIG. 12 shows an element 10 having its heel 14 twisted through 90° so as to direct the planar surface 14*a* outwardly away from the coupling head 11 in contrast to the embodiment shown in FIG. 1.

Figure 13:
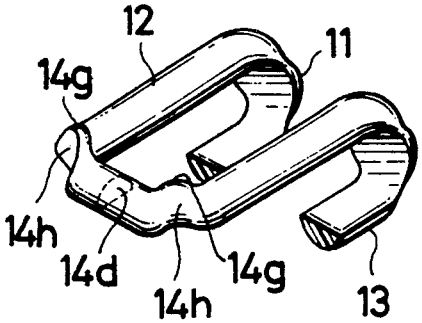
Figure 14:
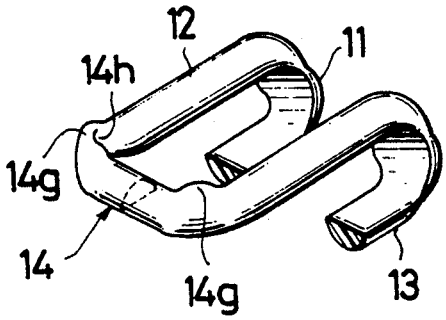

FIGS. 13 and 14 respectively show elements 10 each having the planar surface 14*a* of the heel 14 directed face to face with the tape surface with opposite ends of the heel 14 stamped to form a protuberance 14*g*, the only difference being that a recess 14*h* resulting from stamping is produced externally of the heel 14 in the case of FIG. 13 and internally of the heel 14 in the case of FIG. 14.

Figure 15:
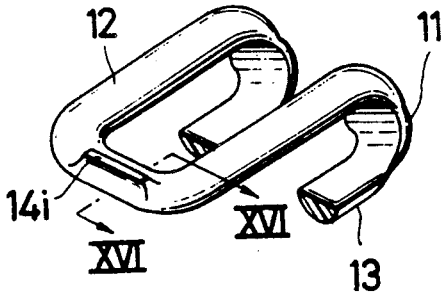
Figure 16:
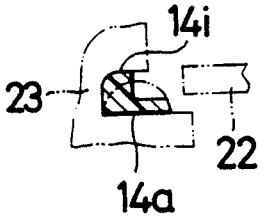

FIG. 15 shows a modified form of meandering element 10 characterized by the formation of an upwardly projecting lug 14*i* substantially over the entire length of the heel 14 by means of a punch 22 and a die 23 schematically illustrated in FIG. 16, the resulting heel 14 having a substantially L-shaped cross-section as taken on the line XVI—XVI of FIG. 15.

The meandering elements 10 shown in FIGS. 13–15 are most suitable for weaving into the stringer tape because of greater flexibility provided at the respective worked surfaces of the heel 14.

Figure 17:
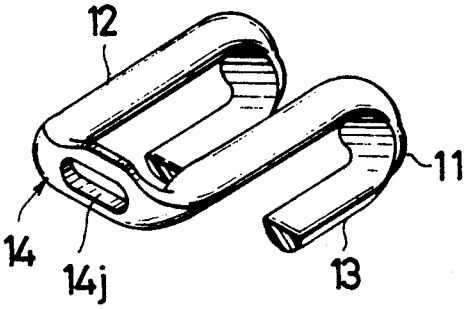

FIG. 17 shows a further modification of FIG. 1 in which the heel 14 has a cavity 14*j* formed in its outer surface 14*d*.

Figure 18:
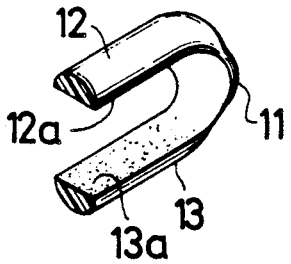

A meandering coupling element 10 shown in FIG. 18 has the planar inner surfaces 12*a*, 13*a* of the upper and lower legs 12, 13 which are rendered coarse so as to provide slip-free, stronger attachment of the element 10 to the stringer tape.

Obviously, various modifications and variations of the present invention are possible in the light of the above teaching. It is therefore to be understood that within the scope of the appended claims the invention may be practiced otherwise than as specifically described.

What is claimed is:

1. A coupling element for a slide fastener which is formed from a substantially cross-sectionally semi-circular monofilamentary material into a continuous meandering structure mounted on a stringer tape, said element having a coupling head, an upper leg and a lower leg respectively extending from opposite ends of said head and a heel interconnecting said legs, at least a portion of said heel protruding beyond the outer surfaces of each of said legs.

2. A coupling element according to claim 1 wherein said heel is oriented by rotation through 90° so as to direct the majority of a planar surface thereof inwardly toward said coupling head.

3. A coupling element according to claim 1 wherein said heel is oriented by rotation through 90° so as to direct a planar surface thereof away from said coupling head.

4. A coupling element according to claim 1 wherein said heel is oriented by rotation through 180° with its planar surface extending parallel with the surface of said tape.

5. A coupling element according to claim 1 wherein a planar surface of said heel is directed face to face with the surface of said tape with opposite ends of said heel stamped to form a protuberance.

6. A coupling element according to claim 1 wherein said heel has an upwardly projecting lug extending substantially over its entire length.

7. A coupling element according to claim 1 wherein said heel has a cavity formed in its outer surface.

8. A coupling element according to claim 1 wherein said upper and lower legs have coarse inner surfaces, respectively.

* * * * *